US008207674B2

(12) United States Patent
Ramaiah

(10) Patent No.: US 8,207,674 B2
(45) Date of Patent: Jun. 26, 2012

(54) DOSE COMPOSITION SUITABLE FOR LOW WATTAGE CERAMIC METAL HALIDE LAMP

(75) Inventor: Raghu Ramaiah, Mentor, OH (US)

(73) Assignee: General Electric Company, Schenectady, NY (US)

( * ) Notice: Subject to any disclaimer, the term of this patent is extended or adjusted under 35 U.S.C. 154(b) by 302 days.

(21) Appl. No.: 12/568,129

(22) Filed: Sep. 28, 2009

(65) Prior Publication Data

US 2010/0033114 A1 Feb. 11, 2010

Related U.S. Application Data

(63) Continuation-in-part of application No. 12/032,715, filed on Feb. 18, 2008, now abandoned.

(51) Int. Cl.
*H01J 17/20* (2012.01)
*H01J 61/20* (2006.01)

(52) U.S. Cl. ..... 313/640; 445/23; 313/567; 313/638; 313/641

(58) Field of Classification Search ..... 313/640, 313/637, 638, 486, 487, 571, 567; 445/23, 445/9

See application file for complete search history.

(56) References Cited

U.S. PATENT DOCUMENTS

| | | | | |
|---|---|---|---|---|
| 5,973,453 | A | 10/1999 | Van Vliet et al. | |
| 6,356,016 | B1 | 3/2002 | Suijker et al. | |
| 6,362,571 | B1 | 3/2002 | Suijker et al. | |
| 7,414,368 | B2 | 8/2008 | Rintamaki et al. | |
| 2003/0102808 | A1 | 6/2003 | Dakin et al. | |
| 2005/0168148 | A1 * | 8/2005 | Allen et al. | 313/634 |
| 2005/0248279 | A1 * | 11/2005 | Lambrechts et al. | 313/640 |
| 2006/0164016 | A1 * | 7/2006 | Rintamaki et al. | 313/638 |
| 2008/0129202 | A1 | 6/2008 | Ramaiah et al. | |
| 2009/0146570 | A1 | 6/2009 | He et al. | |
| 2009/0146571 | A1 | 6/2009 | Russell et al. | |
| 2009/0146576 | A1 | 6/2009 | Russell et al. | |
| 2010/0013417 | A1 * | 1/2010 | Ramaiah et al. | 315/358 |
| 2011/0031879 | A1 * | 2/2011 | Russell et al. | 313/638 |

FOREIGN PATENT DOCUMENTS

| | | | |
|---|---|---|---|
| EP | 04100921.8 | | 3/2004 |
| EP | 04100924.2 | | 3/2004 |
| EP | 04101583.5 | | 4/2004 |
| WO | WO 99/53522 | | 10/1999 |
| WO | WO 99/53523 | | 10/1999 |
| WO | WO 2005/088675 | A1 | 9/2005 |
| WO | WO 2008129466 | A2 * | 10/2008 |
| WO | WO 2008129486 | A2 * | 10/2008 |

* cited by examiner

*Primary Examiner* — Mariceli Santiago
*Assistant Examiner* — Glenn Zimmerman
(74) *Attorney, Agent, or Firm* — Fay Sharpe LLP

(57) ABSTRACT

A lamp includes a discharge vessel with electrodes extending into the discharge vessel and an ionizable fill sealed within the vessel. The fill includes a buffer gas, optionally mercury, and a halide component comprising a sodium halide, a lanthanum halide, a thallium halide, and a calcium halide. The lanthanum halide is present in the halide component at a mol fraction of at least 0.03.

11 Claims, 4 Drawing Sheets

DOSE COMPOSITION SUITABLE FOR LOW WATTAGE CERAMIC METAL HALIDE LAMP

This application claims the priority, as a continuation-in part, of U.S. Application Ser. No. 12/032,715, filed Feb. 18, 2008, now abandoned entitled "Dose Composition Suitable For Hollow Plug Ceramic Metal Halide Lamp," the disclosure of which is incorporated herein by reference in its entirety.

BACKGROUND OF THE DISCLOSURE

The present invention relates generally to ceramic arc discharge lamps and more particularly to a discharge lamp with an end zone having reduced wall thickness and a dose comprising sodium, thallium, calcium, and lanthanum, generally in the form of their halides, which is suitable for lamps having a wattage in the range of 15-100 watts.

Discharge lamps produce light by ionizing a fill material, such as a mixture of metal halide and mercury in an inert gas, such as argon, with an arc passing between two electrodes. The electrodes and the fill material are sealed within a translucent or transparent discharge chamber, which maintains the pressure of the energized fill material and allows the emitted light to pass through. The fill material, also known as a "dose," emits a desired spectral energy distribution in response to being vaporized and excited by the electric arc. For example, halides provide spectral energy distributions that offer a broad choice of light properties, including color temperatures, color rendering, and luminous efficiency.

Conventionally, the discharge chamber in a discharge lamp was formed from a vitreous material such as fused quartz, which was shaped into desired chamber geometries after being heated to a softened state. Fused quartz, however, has certain disadvantages, which arise from its reactive properties at high operating temperatures. For example, in a quartz lamp, at temperatures greater than about 950-1000° C., the halide filling reacts with the glass to produce silicates and silicon halide, which results in depletion of the fill constituents. Elevated temperatures also cause sodium to permeate through the quartz wall, which causes depletion of the fill. Both depletions cause color shift over time, which reduces the useful lifetime of the lamp. Color rendition, as measured by the color rendering index (CRI or Ra) tends to be moderate in existing quartz metal halide (QMH) lamps, typically in the range of 65-70 CRI, with moderate lumen maintenance, typically 65-70%, and moderate to high efficacies of 100-150 lumens per watt (LPW). U.S. Pat. Nos. 3,786,297 and 3,798,487 disclose quartz lamps which use high concentrations of cerium iodide in the fill to achieve relatively high efficiencies of 130 LPW at the expense of the CRI. These lamps are limited in performance by the maximum wall temperature achievable in the quartz arctube.

Ceramic discharge chambers were developed to operate at higher temperatures for improved color temperatures, color renderings, and luminous efficacies, while significantly reducing reactions with the fill material. In general, CMH lamps are operated on an AC voltage supply source with a frequency of 50 or 60 Hz, if operated on an electromagnetic ballast, or higher if operated on an electronic ballast. The discharge is extinguished, and subsequently re-ignited in the lamp, upon each polarity change in the supply voltage.

One problem with such lamps is that the light output deviates from that of "white" light. One way to measure this is as the difference in chromaticity of the lamp's color point, on the y axis (ccy) from that of the standard black body curve plotted on a CIE (Commission Internationale de l'Eclairage) 1931 chromaticity diagram in which the chromaticity coordinates represent relative strengths of two of the three primary colors, denoted by x and y. This chromaticity difference is referred to herein as Dccy. The black body curve (or Planckian locus) represents the color points on the CIE chromaticity diagram traversed by an incandescent object as its temperature is raised and occupies the central white region. Two lamps whose x, y coordinates fall one above the black body curve and one below could have the same correlated color temperature (CCT) while having a different hue. For many applications, it is desirable to have light with virtually no hue, e.g., without a greenish or reddish tint.

The properties of high intensity discharge lamps operated at high temperatures tend to suffer. Ceramics operated at high temperature degrade in their mechanical strength, and consequently the lamps may not withstand the stresses on the ceramic that are present during lamp operation. This leads to premature lamp failure or poor reliability. CRI, lower CCT and dCCy close to the black body locus are often all desired, thus lamp lumen maintenance generally has to be sacrificed.

The exemplary embodiment provides a ceramic metal halide lamp capable of emitting light which is close to the black body curve, which overcomes the above-referenced problems and others.

BRIEF DESCRIPTION OF THE DISCLOSURE

In accordance with one aspect of the exemplary embodiment, a lamp includes a discharge vessel. Electrodes extend into the discharge vessel. An ionizable fill is sealed within the vessel. The fill includes a buffer gas, optionally mercury, and a halide component. The halide component includes a sodium halide, a lanthanum halide, a thallium halide, and a calcium halide. The lanthanum halide is present in the halide component at a mole fraction of at least 0.03.

In accordance with another aspect of the exemplary embodiment, a lamp includes a discharge vessel. Electrodes extend into the discharge vessel. An ionizable fill is sealed within the vessel. The fill includes a buffer gas, optionally mercury, and a halide component. The halide component consists essentially of a sodium halide, a lanthanum halide, a thallium halide, and a calcium halide. The lanthanum halide is present in the halide component at a mole fraction of at least 0.03. Optionally, a source of oxygen is disposed within the discharge vessel.

In accordance with another aspect of the exemplary embodiment, a method of forming a lamp includes providing a discharge vessel, providing electrodes which extend into the discharge vessel, and sealing an ionizable fill within the vessel. The fill includes a buffer gas, optionally mercury, and a halide component comprising a sodium halide, a lanthanum halide, a thallium halide, and a calcium halide. The lanthanum halide is present in the halide component at a mole fraction of at least 0.03. The method further providing for optionally sealing a source of available oxygen in the discharge vessel.

One advantage of at least one embodiment of the present disclosure is the provision of a lamp with improved performance and luminous efficiency.

Another advantage of at least one embodiment of the present disclosure resides in high color rendering index.

Still further advantages will become apparent to those of ordinary skill in the art upon reading and understanding the following detailed description of the preferred embodiments.

DETAILED DESCRIPTION OF THE PREFERRED EMBODIMENTS

Figure 1:
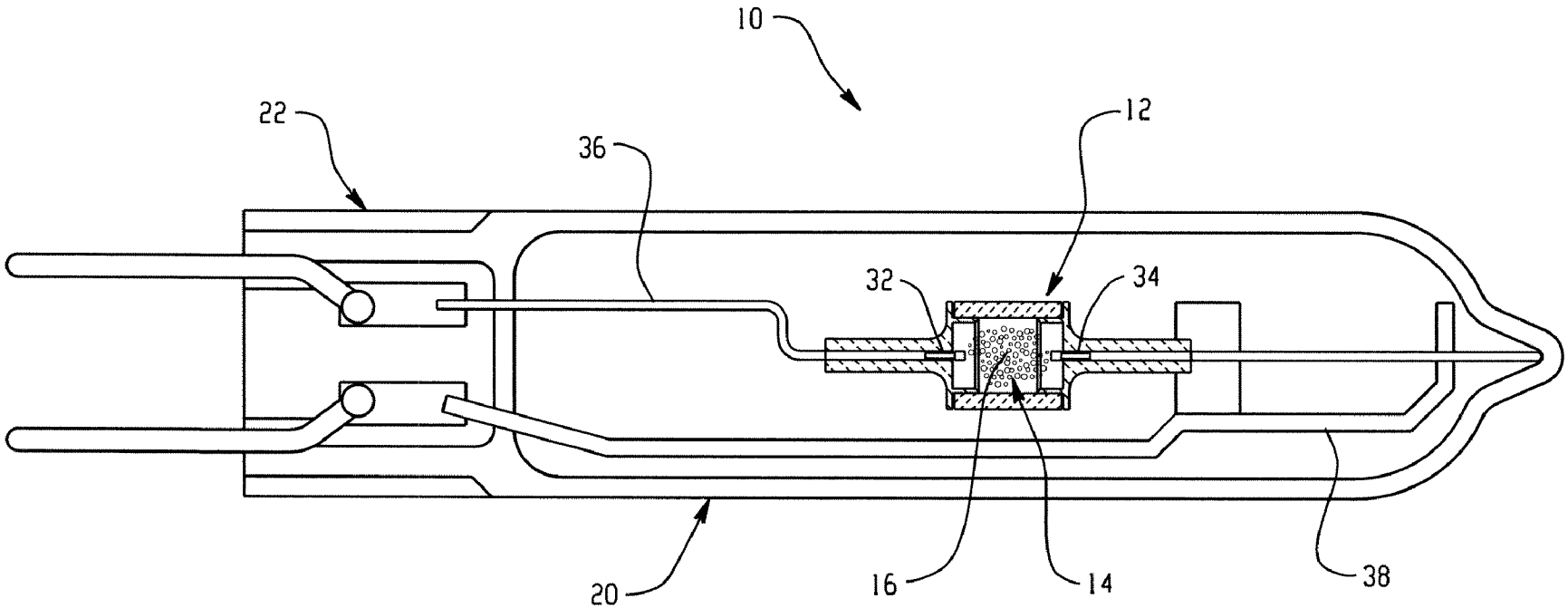
FIG. 1 is a cross sectional view of a lamp in accordance with the exemplary embodiment.

Aspects of the exemplary embodiment relate to a lamp which includes a discharge vessel with an ionizable fill containing lanthanum halide sealed therein. The discharge vessel may include a generally cylindrical or hemispherical barrel and first and second end plugs formed of a ceramic material. The first and second end plugs each include an end wall and at least one tubular leg portion. The end plugs are hollow or have an end wall which is sufficiently thin that the end wall does not tend to perform as a heat sink.

In various aspects, the lamp is able to simultaneously satisfy photometric targets without compromising targeted reliability or lumen maintenance. Some of the photometric properties that are desirable in a lamp design include CRI, CCT, Lumens (e.g., expressed as Lumens/watt), and dCCy.

The color rendering index CRI is a measure of the ability of the human eye to distinguish colors by the light of the lamp. The color rendering index Ra, as used herein, is the standard measure used by the Commission Internationale de l'Elairage (CIE) and refers to the average of the indices for eight standardized colors chosen to be of intermediate saturation and spread throughout a range of hues measured (sometimes referred to as R8). Values are expressed on a scale of 0-100, where 100 represents the value for a black body radiator. The exemplary lamp may have a color rendering index, Ra of at least 85, e.g., at least about 86 Ra, and can be up to about 87, or higher.

The correlated color temperature CCT, as used herein, is the color temperature of a black body radiator which in the perception of the human eye most closely matches the light from the lamp. The exemplary lamp may provide a correlated color temperature (CCT) between about 2700K and about 4500K, e.g., 3000K.

Lumens (lm), as used herein, refer to the SI unit of luminous flux, a measure of the perceived power of light. If a light source emits one candela of luminous intensity into a solid angle of one steradian, the total luminous flux emitted into that solid angle is one lumen. Put another way, an isotropic one-candela light source emits a total luminous flux of exactly $4\pi$ lumens. The lumen can be considered as a measure of the total "amount" of visible light emitted. The output of a lamp can be defined in terms of lumens per Watt (LPW).

In one embodiment the lumens per watt (LPW) of the exemplary lamp at 100 hours of operation is at least 80, and in one specific embodiment, at least about 85 or greater.

dCCy is the difference in chromaticity of the color point on the Y axis (CCY), from that of the standard black body curve. The exemplary embodiment may have a dCCy of $-0.005\pm0.010$ with respect to the black body locus.

All of these ranges may be simultaneously satisfied in the present lamp design. Unexpectedly, this can be achieved without negatively impacting lamp reliability or lumen maintenance. Thus, for example, the exemplary lamp may have a lumen maintenance of approximately 95% or better at 2000 hours, e.g., at a wall temperature which is no greater than 1460K.

With reference to FIG. 1, a lamp assembly comprising a ceramic metal halide (CMH) discharge lamp 10 in accordance with the exemplary embodiment is shown. In other embodiments, the CMH discharge lamp 10 may be housed in a lamp housing 40 having a reflective interior surface, as illustrated in FIG. 2.

The lamp 10 includes a discharge vessel 12 in the form of a high pressure envelope or arctube, formed from a transparent or translucent material, such as polycrystalline alumina or sapphire (single crystal alumina), which is sealed at opposite ends to enclose a chamber or discharge space 14. The discharge vessel is suited to use in lamps operating at a variety of wattages, such as about 15-100 watts, in one embodiment, less than about 75 watts, in another embodiment 20-55 watts, e.g., 20 watts or 39 watts.

Figure 2:
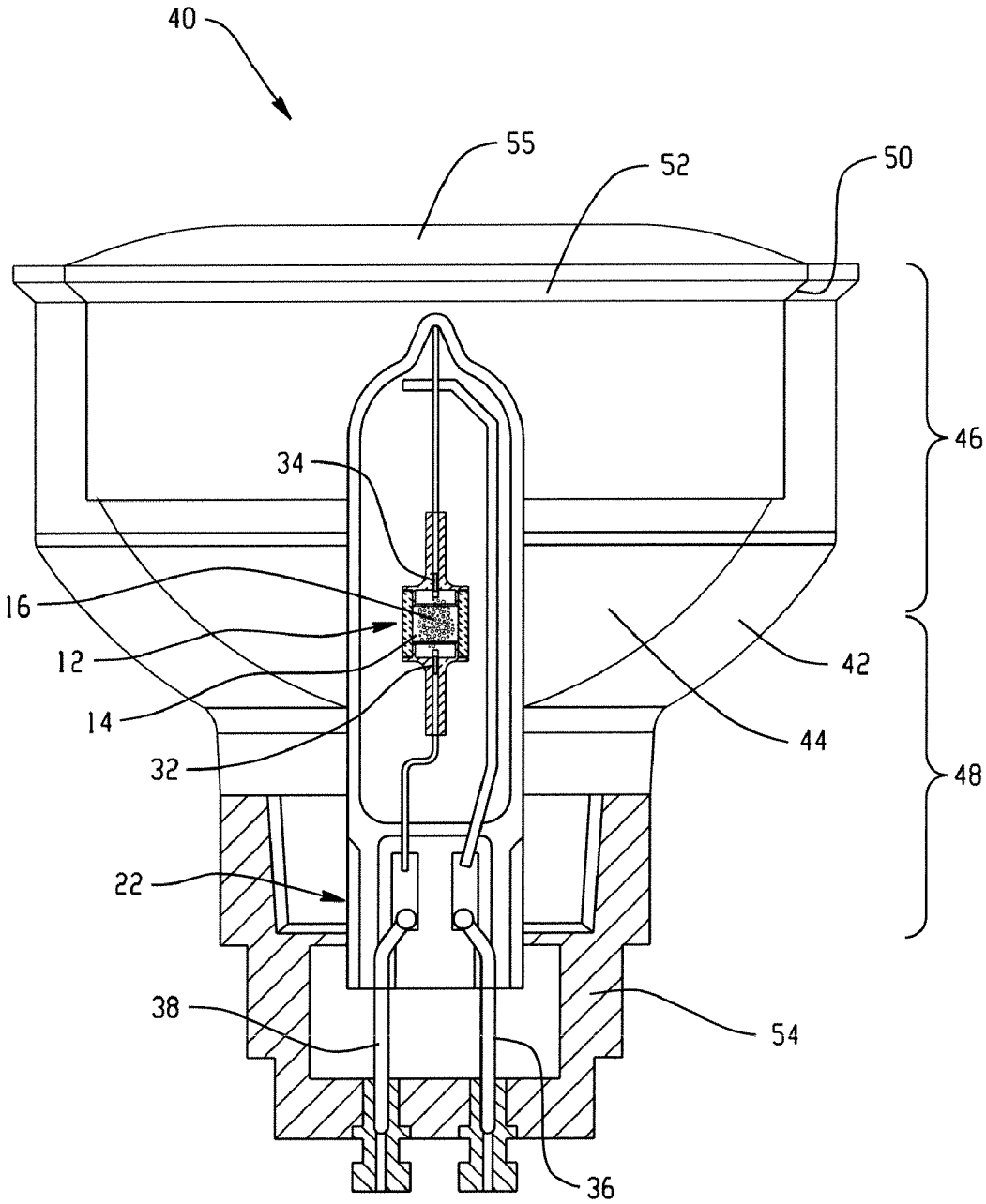
FIG. 2 is a cut-away view of a lamp in a housing in accordance with the exemplary embodiment.

In the embodiments of FIGS. 1 and 2, the discharge space 14 contains a fill of an ionizable gas mixture 16 such as metal halide and inert gas mixture which may also include mercury. The discharge vessel 12 is enclosed in an outer envelope 20 of glass or other suitable transparent or translucent material, which is closed by a lamp cap 22 at one end.

As shown in FIGS. 1 and 2, first and second internal electrodes 32, 34, which may be formed from tungsten, extend into the discharge space 14. A discharge forms in the fill 16 between the electrodes 32, 34 when a voltage is applied across the electrodes. The main electrodes are connected to conductors 36, 38, formed from molybdenum and niobium sections. The connectors electrically connect the electrodes to the external power supply (via the cap 22). It will be appreciated that other known electrode materials may alternatively be used.

With reference to FIG. 2, the lamp housing 40 includes an elongated translucent shell 42 that defines a chamber space 44. The translucent shell 42 defines a reflector portion 46 and a flood portion 48. The reflector portion 46 comprises a light reflecting surface 50 extending from a light emitting end 52 to a flood portion 48 generally intermediate to the light emitting end 52 and a base 54. The end 52 is closed by an appropriate lens 55 of glass or other light transmissive material.

Figure 3:
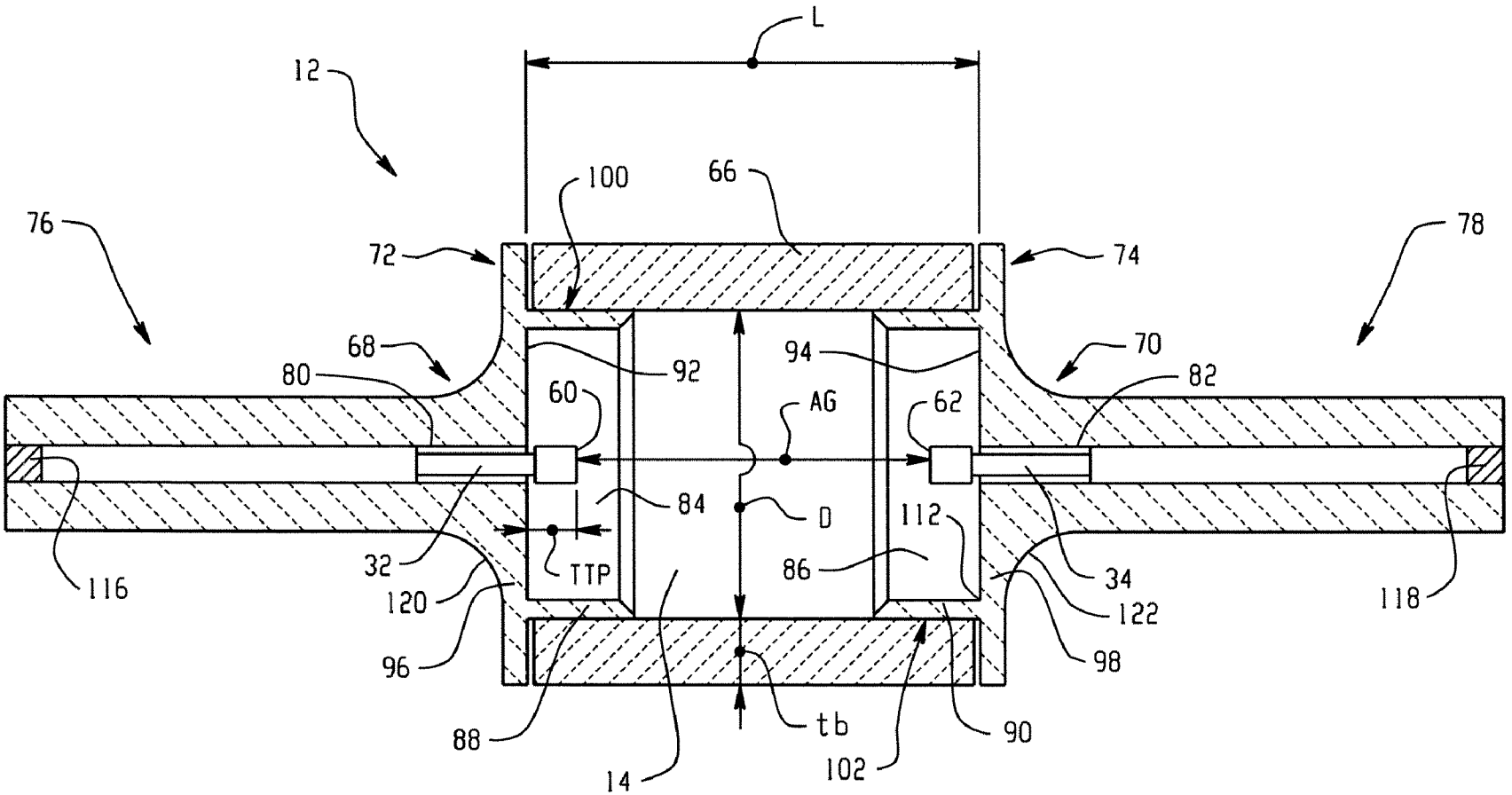
FIG. 3 is an enlarged cross sectional view of the discharge vessel of FIGS. 1 and 2.
Figure 4:
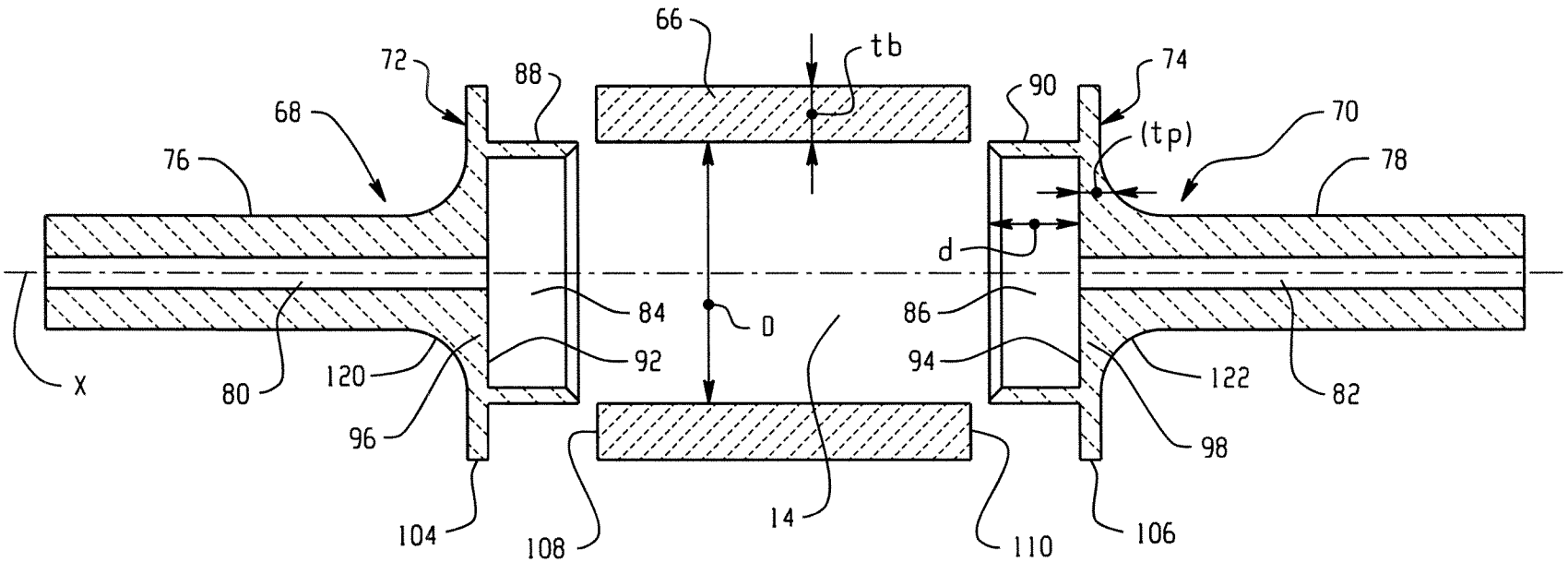
FIG. 4 is an enlarge exploded cross-sectional view of the discharge vessel of FIGS. 1 and 2.

With reference now to FIGS. 3 and 4, tips 60, 62 of the electrodes 32, 34 are spaced by an arc gap AG.

The ceramic arctube 12 includes a hollow cylindrical portion or barrel 6 and two opposed hollow end plugs 68, 70. The barrel 6 and end plugs 68, 70 are formed from separate components (FIG. 4) that are fused together during formation of the lamp. The two end plugs may be similarly shaped and each includes a cylindrical base portion 72, 74, from which respective hollow leg portions or tubes 76, 78 extend outwardly. The electrodes 32, 34 are seated in bores 80, 82 within their respective leg portions 76, 78 and extend into respective hollow portions 84, 86, of the cylindrical base portions 72, 74. Each hollow portion 84, 86 is defined between a cylindrical wall or skirt 88, 90 of the base portion 72, 74 and an interior surface 92, 94 of a respective end wall 96, 98 of the base portion. It may be appreciated that the end plugs may also have a different form such as a shaped or rounded form. The skirts 88, 90 are received in the respective ends of the barrel 6 to create an annular thickened region 100, 102 when the two parts are joined together (FIG. 3). The skirts 88, 90 extend in an annular ring adjacent the barrel. As shown in FIG. 4, the skirt 88, 90 is spaced inwardly from the peripheral edge of the respective end wall 96, 98 by an annular rim portion or flange 104, 106. The flange is seated on a corresponding annular end 108, 110 of the barrel 6 when the arctube 12 is assembled.

The discharge chamber 14 is sealed at the ends of the leg portions 76, 78 by seals 116, 118 (FIG. 3), to create a gas-tight discharge space.

In one embodiment, each of end plugs 68, 70 includes an annular curved portion or fillet 120, 122, which extends between the substantially uniform thickness leg portion 76, 78 and the end wall 96, 98, which gives ends of the leg portions a contoured appearance. This avoids sharp corners between the legs 76, 78 and the end walls 96, 98, which could otherwise contribute to fractures. The curved portions 120, 122 typically have a radius of curvature of about 0.5-3.0 millimeters. Alternatively, the leg portions may be tapered.

Various dimensions of the arctube will now be defined:

The ceramic wall thickness tb is defined as the thickness (mm) of the wall material in the central portion of the arctube body, e.g., half way between the electrode tips. The tb may be, for example, about 0.5-2.0 mm, e.g., about 0.6-1.2 mm. In general, tb may be higher for higher wattage lamps.

The plug thickness tp is the thickness of the end wall of the plug (FIG. 4). Where the end wall is contoured, the minimum plug thickness tpmin is typically in the corner, where the skirt meets the end wall. In one embodiment, tpmin is greater than 0.10 mm.

The plug depth d is the interior dimension of the hollow portion of the plug (FIG. 4). In general d≧0.8*tpmin or ≧1.0tpmin. In some embodiments, d>1.0*tpmin and in the illustrated embodiment, d≧1.5*tpmin.

3-8 mm, e.g., about 4.65 mm. The tip-to-plug distance (TTP) or tip protrusion is the distance (mm) from the electrode tip 60, 62 to the adjacent respective surface 92, 94 of the end wall of the plug defining the internal end of the arctube body. The arc gap is related to the internal arctube length L and TTP by the relationship AG+2TTP=L. Optimization of TTP leads to an end structure hot enough to provide the desired halide pressure, but not too hot to initiate corrosion of the ceramic material. In one embodiment, TTP is about 0.7-2.0 mm, for example, about 0.9-2.0 mm, e.g., about 1.3 mm.

As used herein, "Arctube Wall Loading" (WL) is the arctube power (watts) divided by the arctube surface area (square cm). For purposes of calculating WL, the surface area is the total internal surface area including end bowls, but excluding legs, and the arctube power is the total arctube power including electrode power. WL can be ≦52 w/cm$^2$. In one embodiment, the wall loading is from about 12 to 34 w/cm$^2$, for example, about 22 w/cm$^2$. Such a wall loading can be achieved when the wall temperature is about 1460K maximum.

For lamps of 20, 39, or 70 watts, dimensions of exemplary lamps can thus be as shown in Table 1:

TABLE 1

| Parameter | Abbreviation (Units) | Range | Exemplary Range for 20 W Lamp | Exemplary Range for 39 W Lamp | Exemplary Range for 70 W Lamp |
|---|---|---|---|---|---|
| Wall Thickness | Tb (mm) | 0.5-2.0 | 0.5-1.2 | 0.6-1.2 | 1.3-1.7 |
| Plug Thickness | Tp (mm) | 0.1-1.5 | 0.15-1.0 | 0.15-1.0 | 0.6-0.8 |
| Plug Depth | d (mm) | 0.8-2.5 | 1.0-2.5 | 1.0-2.5 | 1.2-1.5 |
| Inner Length | L (mm) | 4.0-10.0 | 4.0-6.0 | 6.0-8.5 | 7.5-8.5 |
| Inner Diameter | D (mm) | 4.0-8.0 | 4.0-7.0 | 5.0-7.0 | 5.5-6.8 |
| Arc Gap | AG (mm) | 3.0-8.0 | 3.0-7.0 | 3.0-7.0 | 5.5-6.0 |
| Tip-To-Plug | TTP (mm) | 0.7-2.0 | 0.7-2.0 | 0.7-2.0 | 1.0-1.4 |
| Wall Loading | WL (w/cm$^2$) | 11.0-52.0 | 18.0-52.0 | 14.0-30.0 | 29.0-32.0 |

The arctube length L is the internal distance between the end walls (in mm) (FIG. 3). The L, as measured along the lamp axis X can be, for example, about 4-10 mm. The arctube diameter D is the internal diameter of the arctube, measured in a region between the electrodes (FIG. 3). D can be, for example, about 4-8 mm. The aspect ratio (L/D) is defined as the internal arctube length divided by the internal arctube diameter and can be, for example, between about 0.5 and 2.5, for example, about 1.28.

The end walls 96, 98 are provided with a thickness tp large enough to spread heat, but small enough to prevent or minimize light blockage. Discrete interior corners 112 provide a preferred location for halide condensation. The structure of the end wall 96, 98 enables a more favorable optimization, for example, one with a lower aspect ratio (L/D) as illustrated in FIG. 3. The following features, alone or in combination, have been found to assist in optimizing performance: 1) a smooth fillet transition between the exterior end and the leg so as to reduce stress concentrations, 2) an end thickness tp large enough to spread heat, but small enough to prevent light blockage and avoiding serving as a significant heat sink, and 3) discrete corners 112 to provide a preferred location for halide condensation.

The arc gap AG is the distance (mm) between the electrode tips 60, 62 at the closest point and can be, for example, about The exemplary cylindrical portion 66 and end plugs 68, 70 are all formed from a polycrystalline aluminum oxide ceramic, although other polycrystalline ceramic materials capable of withstanding high wall temperatures up to 1700-1900° K. and which are resistant to attack by the fill materials are also contemplated.

The exemplary fill 16 includes a metal halide component or "dose" which includes halides of sodium, thallium, calcium, and lanthanum. The fill may further include mercury and a rare gas, such as argon or xenon. The halides may be chlorides, bromides, or iodides. In one embodiment, iodides of sodium, thallium, calcium, and lanthanum are the only halides included in the fill. In particular, the lamp fill is free of all other rare earth halides, such as dysprosium, cerium, and the like. By "free," it is meant that these rare earth halides, where present, represent, in total, no more than 1 mole % of the halides in the dose, and generally less than 0.5 mole %. The halide component, in this embodiment, thus consists essentially of a sodium halide, a lanthanum halide, a thallium halide, and a calcium halide. In some embodiments, rare earth halides, other than mentioned above, are at a mole % of <0.01, or <0.001, i.e. as close to a mole % of 0% as can be practically achieved.

Mole fractions (moles of a dose component divided by total moles of the halide dose components) may be as follows, where X represents Cl, Br, I, or combinations thereof:

NaX >0.3, e.g., 0.4-0.9, such as about 0.63.

TIX >0.01, e.g., at least 0.02, e.g., 0.015-0.04, such as about 0.025.

$CaX_2$ >0.09, e.g., 0.1-0.4, such as about 0.3.

$LaX_3$ >0.009, e.g., at least 0.02 or at least 0.07, and can be up to 0.3, e.g., up to 0.130.

In one embodiment, all the halide are iodides.

In one embodiment, the mole fractions of the dose components are in the relationship $NaI:TlI:CaI_2:LaI_3$=0.625:0.025:0.25:0.10, where each value can vary by ±30% of its value, yet keeping the sum of mole fractions equal to 1.

The halide weight (HW), which is the weight (mg) of the halides in the arctube 12, can be from about 4-14 mg, and for the embodiment illustrated, a halide weight of 8.8 mg or 47.2 mg/cc is employed. Different sized vessels for higher/lower wattages may employ different amounts.

In one embodiment, the discharge vessel 12 may enclose a source of available oxygen. The oxygen provided by the source aids in the wall cleaning cycle and thus can improve lumen maintenance over the lifetime of the lamp. Various methods exist for providing oxygen in the fill during operation of the lamp. For example, as described in application Ser. Nos. 11/951,677, 11/951,724, and 12/270,216, the source of available oxygen may be one that, under the lamp operating conditions, makes oxygen available for reaction with other fill components to form $WO_2X_2$, where X is a halide. The source of available oxygen gas may be an oxide that is unstable under lamp operating temperatures, such as an oxide of tungsten, free oxygen gas ($O_2$), water, molybdenum oxide, mercury oxide, dioxides of lanthanum, cerium, neodymium, samarium, praseodymium, or a combination thereof. The oxide of tungsten may have the general formula $WO_nX_m$, where n is at least 1, m can be ≧0 and X is as defined above. Exemplary tungsten oxides include $WO_3$, $WO_2$, and tungsten oxyhalides, such as $WO_2I_2$, and combinations thereof. The available oxygen may be present in the lamp at a concentration of at least 0.2 μmol $O_2$/cc, e.g., at least 0.28 μmol $O_2$/cc, and in one embodiment, at least 0.4 μmol $O_2$/cc or at least 0.6 μmol $O_2$/cc of lamp volume. In one specific embodiment, the oxygen is present at a concentration of at least 0.8 μmol $O_2$/cc. The available oxygen may be present at up to 3.0 μmol $O_2$/cc, e.g., up to 2.2 μmol $O_2$/cc, and in specific embodiments, up to 2.0 or 1.8 or 1.6 μmol $O_2$/cc. As will be appreciated, certain oxides do not decompose readily to form available oxygen under lamp operating conditions, such as cerium oxide ($Ce_2O_3$) and calcium oxide, and thus do not tend to act effectively as sources of oxygen. In general, most oxides of rare earth elements ($RE_2O_3$) are not suitable sources of available oxygen as they are stable at lamp operating temperatures.

In one embodiment, as the source of oxygen the tungsten electrode 32, 34 is partially oxidized to form tungsten oxide, e.g., a spot on its surface is thermally oxidized prior to insertion into the lamp, to provide the source of available oxygen. In other embodiments, comminuted tungsten oxide, such as tungsten oxide chips, may be introduced in the discharge vessel.

Alternatively, the source of oxygen may include a calcium oxide or tungsten oxide oxygen dispenser provided in the discharge vessel, as disclosed, for example in WO 99/53522 and WO 99/53523 to Koninklijke Philips Electronics N.V.

In the exemplary embodiment, a ceramic metal halide lamp is provided which is capable of more easily meeting all the technical requirements in terms of dCCy, CRI, CCT and Lumens, without impacting lamp reliability and lumen maintenance.

The ceramic arctube may be formed from a single component or from multiple components. In a first embodiment, the arctube 12 is assembled from separate components. In the arctube of FIG. 4, there are three main components, the two end plugs 68, 70 and the cylindrical barrel portion 66, although fewer or greater numbers of components may be employed. The end plugs 68, 70 may be formed as single components (see FIG. 4) or may be separately assembled from the leg portions and base portions.

The components are fabricated, for example, by die pressing, injection molding, or extruding a mixture of a ceramic powder and a binder system into a solid body. For die pressing, a mixture of about 95-98% of a ceramic powder and about 2-5% of a binder system is pressed into a solid body. For injection molding, larger quantities of binder are used, typically 40-55% by volume of binder and 60-45% by volume ceramic material.

In one embodiment, the cylindrical portion body member 66 and the plug members 68, 70 can be constructed by die pressing a mixture of a ceramic powder and a binder into a solid cylinder. Typically, the mixture comprises 95-98% by weight ceramic powder and 2-5% by weight organic binder. The ceramic powder may comprise alumina ($Al_2O_3$) having a purity of at least 99.98% and a surface area of about 2-10 $m^2$/g. The alumina powder may be doped with magnesia to inhibit grain growth, for example in an amount equal to 0.03%-0.2%, in one embodiment, 0.05%, by weight of the alumina. Other ceramic materials which may be used include non-reactive refractory oxides and oxynitrides such as yttrium oxide, lutetium oxide, and hafnium oxide and their solid solutions and compounds with alumina such as yttrium-aluminum-garnet and aluminum oxynitride. Binders which may be used individually or in combination include organic polymers such as polyols, polyvinyl alcohol, vinyl acetates, acrylates, cellulosics and polyesters.

An exemplary composition which can be used for die pressing a solid cylinder comprises 97% by weight alumina powder having a surface area of 7 $m^2$/g, available from Baikowski International, Charlotte, N.C. as product number CR7. The alumina powder was doped with magnesia in the amount of 0.1% of the weight of the alumina. An exemplary binder includes 2.5% by weight polyvinyl alcohol and 1/2% by weight Carbowax 600, available from Interstate Chemical.

Subsequent to die pressing, the binder is removed from the green part, typically by thermal pyrolysis, to form a bisque-fired part. The thermal pyrolysis may be conducted, for example, by heating the green part in air from room temperature to a maximum temperature of about 900-1100° C. over 4-8 hours, then holding the maximum temperature for 1-5 hours, and then cooling the part. After thermal pyrolysis, the porosity of the bisque-fired part is typically about 40-50%.

The bisque-fired part is then machined. For example, a small bore may be drilled along the axis of the solid cylinder which provides the bore 80, 82 of the plug portion 68, 70 in FIG. 4. A larger diameter bore may be drilled along a portion of the axis of the plug portion to define the flange 104, 106. Finally, the outer portion of the originally solid cylinder may be machined away along part of the axis, for example with a lathe, to form the outer surface of the plug portion.

The machined parts are typically assembled prior to sintering to allow the sintering step to bond the parts together. According to an exemplary method of bonding, the densities of the bisque-fired parts used to form the cylindrical portion body member 66 and the plug members 68, 70 are selected to achieve different degrees of shrinkage during the sintering step. The different densities of the bisque-fired parts may be achieved by using ceramic powders having different surface areas. For example, the surface area of the ceramic powder used to form the body member 66 may be 6-10 $m^2$/g, while the surface area of the ceramic powder used to form the end plug members 68, 70 may be 2-3 $m^2/g$. The finer powder in the body member causes the bisque-fired cylindrical portion body member 66 to have a smaller density than the bisque-fired end plug members 68, 70 made from the coarser powder. The bisque-fired density of the cylindrical portion body member 66 is typically 42-44% of the theoretical density of alumina (3.986 $g/cm^3$), and the bisque-fired density of the end plug members 68, 70 is typically 50-60% of the theoretical density of alumina. Because the bisque-fired body member 66 is less dense than the bisque-fired plug members 68, 70 the body member 66 shrinks to a greater degree (e.g., 3-10%) during sintering than the plug member 68, 70 to form a seal around the flange 104, 106. By assembling the three components 66, 68, 70 prior to sintering, the sintering step bonds the two components together to form a discharge chamber.

The sintering step may be carried out by heating the bisque-fired parts in hydrogen having a dew point of about 10-15° C. Typically, the temperature is increased from room temperature to about 1850-1880° C. in stages, then held at 1850-1880° C. for about 3-5 hours. Finally, the temperature is decreased to room temperature in a cool down period. The inclusion of magnesia in the ceramic powder typically inhibits the grain size from growing larger than 75 microns. The resulting ceramic material comprises a densely sintered polycrystalline alumina.

According to another method of bonding, a glass frit, e.g., comprising a refractory glass, can be placed between the body member 46 and the plug member 48, 50, which bonds the two components together upon heating. According to this method, the parts can be sintered independently prior to assembly.

The body member 66 and plug members 68, 70 typically each have a porosity of less than or equal to about 0.1%, preferably less than 0.01%, after sintering. Porosity is conventionally defined as the proportion of the total volume of an article which is occupied by voids. At a porosity of 0.1% or less, the alumina typically has a suitable optical transmittance or translucency. The transmittance or translucency can be defined as "total transmittance," which is the transmitted luminous flux of a miniature incandescent lamp inside the discharge chamber divided by the transmitted luminous flux from the bare miniature incandescent lamp. At a porosity of 0.1% or less, the total transmittance is typically 95% or greater.

According to another exemplary method of construction, the component parts of the discharge chamber are formed by injection molding a mixture comprising about 45-60% by volume ceramic material and about 55-40% by volume binder. The ceramic material can comprise an alumina powder having a surface area of about 1.5 to about 10 $m^2/g$, typically between 3-5 $m^2/g$. According to one embodiment, the alumina powder has a purity of at least 99.98%. The alumina powder may be doped with magnesia to inhibit grain growth, for example, in an amount equal to 0.03%-0.2%, e.g., 0.05%, by weight of the alumina. The binder may comprise a wax mixture or a polymer mixture.

In the process of injection molding, the mixture of ceramic material and binder is heated to form a high viscosity mixture. The mixture is then injected into a suitably shaped mold and subsequently cooled to form a molded part.

Subsequent to injection molding, the binder is removed from the molded part, typically by thermal treatment, to form a debindered part. The thermal treatment may be conducted by heating the molded part in air or a controlled environment, e.g., vacuum, nitrogen, rare gas, to a maximum temperature, and then holding the maximum temperature. For example, the temperature may be slowly increased by about 2-3° C. per hour from room temperature to a temperature of 160° C. Next, the temperature is increased by about 100° C. per hour to a maximum temperature of 900-1 100° C. Finally, the temperature is held at 900-1100° C. for about 1-5 hours. The part is subsequently cooled. After the thermal treatment step, the porosity is about 40-50%.

The seals 116, 118 typically comprise a dysprosia-alumina-silica glass and can be formed by placing a glass frit in the shape of a ring around one of the leadwires 36, 38, aligning the arctube 12 vertically, and melting the frit. The melted glass then flows down into the leg 76, 78, forming a seal 116, 118 between the conductor and the leg. The arctube is then turned upside down to seal the other leg after being filled with the fill material.

Without intending to limit the exemplary embodiment, the following Examples demonstrate the performance of the exemplary lamp.

EXAMPLES

Example 1

A 39W Ceramic Metal Halide Single-Ended lamp according to the embodiment shown in FIG. 1, was formed with an arc gap of 4.65 mm, a barrel length L of 7.3 mm, a dose weight of 8.8 mg, or 47.2 mg/cc and mole fractions of: NaI: 0.562, TlI: 0.022, $CaI_2$: 0.305, and $LaI_3$: 0.111 (totaling 1.0) in a fill containing mercury (5.7 mg) and argon gas at a fill pressure of 120 Torr. Table 2 illustrates additional properties of the lamp.

TABLE 2

| | Test Cell Sample A |
|---|---|
| Wall Thickness Tb (mm) | 0.6 |
| Plug Thickness Tp (mm) | 0.6 |
| Plug Depth d (mm) | 1.8 |
| Inner Diameter D (mm) | 5.7 |
| Tip-To-Plug TTP (mm) | 1.33 |
| Wall Loading WL ($W/cm^2$) | 21.5 |
| Lumens (LPW) @ 100 hours | 90 |
| CCT (degrees K) | 3012 |
| CRI (Ra) | 86 |
| dCCY | −0.004 |
| Maximum Wall Temperature (degrees K) | 1380 |

Example 2

A 39W Ceramic Metal Halide lamp, housed in a lamp housing having a reflective interior surface as illustrated in FIG. 2, was formed with an arc gap of 4.65 mm, a barrel length L of 7.3 mm, a dose weight of 6.4 mg, or 34.4 mg/cc and mole fractions of: NaI: 0.574, TlI: 0.021, $CaI_2$: 0.297, and $LaI_3$: 0.108 (totaling 1.0) in a fill containing mercury (5.5 mg) and argon gas at a fill pressure of 120 Torr. Table 3 illustrates a lower LPW for a CMH lamp housed in a lamp having a reflecture compared to a lamp without a housing. Table 3 illustrates additional properties of the lamp.

TABLE 3

| | Test Cell Sample B |
|---|---|
| Wall Thickness Tb (mm) | 0.6 |
| Plug Thickness Tp (mm) | 0.6 |
| Plug Depth d (mm) | 1.8 |
| Inner Diameter D (mm) | 5.7 |

TABLE 3-continued

| | Test Cell Sample B |
|---|---|
| Tip-To-Plug TTP (mm) | 1.33 |
| Wall Loading WL (W/cm$^2$) | 21.5 |
| Lumens (LPW) @ 100 hours | 63 |
| CCT (degrees K) | 3050 |
| CRI (Ra) | 89 |
| dCCY | −0.002 |
| Maximum Wall Temperature (degrees K) | 1450 |

As can be seen from Table 3, there was a loss in lumen output resulting from the use of a lamp housing, although, other properties were substantially unchanged.

Example 3

A 39W Ceramic Metal Halide Single-Ended lamp according to the embodiment shown in FIG. 1, was formed with an arc gap of 4.65 mm, a barrel length L of 7.6 mm, a dose weight of 8.0 mg, or 41.25 mg/cc and mole fractions of: NaI: 0.677, TlI: 0.047, $CaI_2$: 0.201, and $LaI_3$: 0.074 (totaling 1.0) in a fill containing mercury (5.3 mg) and argon gas at a fill pressure of 120 Torr. Table 4 illustrates additional properties of the lamp.

TABLE 4

| | Test Cell Sample D |
|---|---|
| Wall Thickness Tb (mm) | 0.6 |
| Plug Thickness Tp (mm) | 0.6 |
| Plug Depth d (mm) | 1.8 |
| Inner Diameter D (mm) | 5.7 |
| Tip-To-Plug TTP (mm) | 1.48 |
| Wall Loading WL (W/cm$_2$) | 20.8 |

In another study, targets for photometric values were established as follows:

| | |
|---|---|
| La Mole Fraction | 0.08 |
| Lumens | 3590 |
| CRI | 87 |
| CCT | 2900 |
| dCCy | 0.001 |

In one experiment, the mole fraction of lanthanum halide in lamps otherwise similar to those of Example 1 was varied at 3 levels (0.05, 0.08, and 0.11 mol fraction). However, the results indicated that the lamps with the 0.08 mol fraction most closely matched the targets. As will be appreciated, if somewhat different targets are desired, or other targets are less important, the lamps with a mol fraction of 0.05 or 0.11 would allow these targets to be achieved.

TABLE 5

| | Mole Fraction Lanthanum (La) Deviation from Target | | |
|---|---|---|---|
| La Mole Fraction | 0.05 | 0.08 | 0.11 |
| Lumens | −573 | 0 | 573 |
| CRI | −0.9 | 0 | 0.9 |
| CCT | −502 | 0 | 502 |
| dCCy | −0.017 | 0 | 0.017 |

The invention has been described with reference to the preferred embodiments. Obviously, modifications and alterations will occur to others upon reading and understanding the preceding detailed description. It is intended that the invention be construed as including all such modifications and alterations.

What is claimed is:

1. A lamp comprising:
a discharge vessel;
electrodes extending into the discharge vessel;
an ionizable fill sealed within the vessel, the fill comprising:
a buffer gas,
optionally mercury,
a halide component consisting of a sodium halide, a lanthanum halide, a thallium halide, and a calcium halide,
and wherein the mole fractions of the halide dose components are in the relationship NaI:TlI:$CaI_2$:$LaI_3$=0.625:0.025:0.25:0.10, wherein each value vary by no more than ±30% of its value.

2. The lamp of claim 1, wherein the lamp simultaneously satisfies the following targets:
a wall loading of less than 52 w/cm$^2$;
a Dccy of −0.005+/−0.010;
a correlated color temperature (CCT) between about 2700 K and about 4500 K;
a CRI of at least 85; and
a lumen output at 100 hours of at least 80 LPW without a lamp housing.

3. The lamp of claim 2, wherein the lamp further satisfies a lumen maintenance of at least 95% at 2000 hours, at wall temperature which is no greater than 1460 K.

4. The lamp of claim 1, wherein the discharge vessel includes a generally cylindrical wall sealed in at least one end by a hollow plug which carries an electrode therethrough.

5. The lamp of claim 1, wherein the lamp vessel includes a generally cylindrical wall sealed at either end by a plug which carries an electrode therethrough, the plug having an end wall with a minimum thickness which is greater than 0.15 mm.

6. The lamp of claim 1, wherein the fill includes mercury.

7. The lamp of claim 1, wherein a source of available oxygen is disposed in the discharge vessel.

8. The lamp of claim 1, comprising a geometry whereby:
a wall thickness (tb) is from 0.5-2.0 mm;
a plug thickness (tp) is from 0.1-1.5 mm;
an inner length (L) is from 4-10 mm;
an inner diameter (D) is from 4-8 mm;
an arc gap (AG) is from 3-8 mm;
a tip-to-plug distance (TTP) is from 0.7-2.0 mm; and
wall loading (WL) is from 11-52 w/cm$^2$.

9. A lamp comprising:
a discharge vessel;
electrodes extending into the discharge vessel;
an ionizable fill sealed within the vessel, the fill comprising:
a buffer gas,
optionally mercury,
a halide component consisting essentially of a sodium halide, a lanthanum halide, a thallium halide, and a calcium halide, wherein the mole fractions of the halide dose components are in the relationship NaI:TlI:$CaI_2$:$LaI_3$=0.625:0.025:0.25:0.10, wherein each value vary by no more than ±30% of its value; and
optionally, a source of available oxygen,
sealed within the discharge vessel.

10. The lamp of claim 9, wherein the lamp further satisfies a lumen maintenance of at least 95% at 2000 hours, at wall temperature which is no greater than 1460 K.

11. A method of forming a lamp comprising:

providing a discharge vessel;

providing electrodes which extend into the discharge vessel;

sealing an ionizable fill within the vessel, the fill comprising:

a buffer gas, optionally mercury, and a halide component consisting of a sodium halide, a lanthanum halide, a thallium halide, and a calcium halide, wherein the mole fractions of the halide dose components are in the relationship $NaI:TlI:CaI_2:LaI_3=0.625:0.025:0.25:0.10$, wherein each value vary by no more than ±30% of its value; and optionally, sealing a source of available oxygen in the discharge vessel.

* * * * *